US006561717B1

(12) United States Patent
Martinez et al.

(10) Patent No.: US 6,561,717 B1
(45) Date of Patent: May 13, 2003

(54) SELF ALIGNING SHIM FOR A STEP PIN ASSEMBLY

(75) Inventors: David V. Martinez, Burlington, IA (US); Byron R. Moore, Burlington, IA (US)

(73) Assignee: Case Corporation, Racine, WI (US)

( * ) Notice: Subject to any disclaimer, the term of this patent is extended or adjusted under 35 U.S.C. 154(b) by 0 days.

(21) Appl. No.: 10/038,852

(22) Filed: Dec. 31, 2001

(51) Int. Cl.[7] ..... B25G 3/00
(52) U.S. Cl. ..... 403/154; 403/157; 403/156
(58) Field of Search ..... 403/156, 154, 403/150, 157

(56) References Cited

U.S. PATENT DOCUMENTS 2,509,285 A * 5/1950 Bendicsen ..... 403/157 X
5,209,594 A * 5/1993 Svensson et al. ..... 403/156 X
6,322,280 B1 * 11/2001 Coyne ..... 403/154 X

* cited by examiner

*Primary Examiner*—Lynne H. Browne
*Assistant Examiner*—John Cottingham
(74) *Attorney, Agent, or Firm*—A. N. Trausch

(57) ABSTRACT

A shim for use in combination with a pin and fastener assembly, the pin having a shank portion with an outer diameter and a shoulder on an end of the shank portion, the shoulder defining a reduced diameter portion having threads, the fastener adapted for engagement with the threads on the reduced diameter portion, the shim includes at least one annular member having an inner diameter and an outer diameter with a flat portion at the inner diameter and a cupped portion at the outer diameter, the inner diameter adapted to fit over the outer diameter of the shank portion of the pin, the cupped portion receiving the fastener when the fastener is engaged with the threads on the reduced diameter portion of the pin so as to restrict radial movement of the shim as the fastener is threaded into abutting contact with the shoulder on the pin.

12 Claims, 7 Drawing Sheets

SELF ALIGNING SHIM FOR A STEP PIN ASSEMBLY

FIELD OF THE INVENTION

The present invention is related to a shim and step pin assembly and more particularly to a step pin assembly having a self aligning shim for providing a compression pre-load to a forked mounting flange.

BACKGROUND OF THE INVENTION

Construction equipment has many component parts that move relative to another machine part to perform the work of the machine. The moving component parts are often rotated about a pivot joint such as a pivot pin. Linear actuators, such as hydraulic cylinders often cause rotation of the parts. For example, a backhoe or excavator has a boom arm that pivots about a boom base on the vehicle body. A dipper arm then pivots relative to the boom arm at a pivot joint on the distal end of the boom arm.

A known pivot joint for connecting the boom arm and the dipper arm is constructed with a pivot pin through a boom arm having two, generally parallel, spaced-apart mounting flanges. A pair of aligned bores are provided in the mounting flanges. The dipper arm is constructed with a mounting portion having a lateral dimension sized to fit between the mounting flanges. The mounting portion also has a lateral bore. When the mounting portion is positioned between the spaced-apart flanges, the bore in the mounting portion is aligned with the bores in the flanges.

The hardened pivot pin is then inserted through the aligned bores to allow the dipper arm to pivot relative to the boom arm. The pivot pin is axially retained within the mounting flanges by a combination of locking pins, snap rings, threaded fasteners or an enlarged head on one end of the pin.

A known boom arm is preferably constructed as an integral cast member from a cast metal such as ductile iron. A cast boom arm is strong, economic and requires less assembly than a boom arm assembled from metal plates, for example. The cast boom arm has a pair of vertically orientated wall portions with integral cross-supports. The distal end of the wall portions are extended and left open to form cantilevered mounting flanges for pivotal connection of a dipper arm member.

A boom arm and especially the mounting flanges of the boom arm are often subjected to twisting or torsion stress during use. For example, twisting stress occurs on the mounting flange portion of the boom arm when the bucket on the extended dipper arm encounters a sideways force, such as when the bucket is swung into the side of a trench. It is therefore necessary to reinforce the mounting flange portion of a boom arm to resist this twisting or torsion stress. Adding additional structure, which adds weight and increases manufacturing costs, is not the preferred mechanism for reinforcing the mounting flange portion.

The mounting flange portion of a cast boom arm structure can be preloaded with a favorable compression stress to counteract the undesirable twisting stress. To preload a cast boom arm against twisting stress, the lateral gap between the mounting flanges is designed and constructed to initially be oversized. An oversized lateral gap between the mounting flanges has a larger opening than is required to fit the lateral width of the mounting portion of the dipper arm.

The two cantilevered mounting flanges of the cast boom arm are then pulled together by the pivot pin and fastener, such as with a threaded pivot pin and nut, to reduce the final lateral span in the oversized gap. Reducing the final span also provides a snug non-binding fit for the dipper arm between the mounting flanges of the boom arm. When the nut is tightened on the pivot pin and closes the initial oversized gap between the mounting flanges, the tightening creates a compression pre-load on the boom arm. The compression pre-load on the flanges counteracts the undesirable twisting stress that acts on the mounting flanges of the boom arm during operation of the backhoe.

It is difficult to control casting dimensions for large castings such as a boom arm. The dimensions of the lateral gap between the mounting flanges are difficult to manufacture within reasonable tolerances. To avoid extra machining, the manufacturing tolerances for the mounting flanges on the known cast boom arm are designed so that the tolerance stack-up due to casting variations always produces at least the desired oversized gap. Shims are used to take up the oversized portion of the lateral gap created by the tolerance stack-up.

A step pin, rather than a straight pivot pin, is used with the known cast boom arm to achieve the desired compression preload and the final lateral gap dimension between the mounting flanges. The step pin is manufactured to have a perpendicular shoulder at a predetermined axial position along the pin. The shoulder defines a reduced diameter portion having threads for engagement with a threaded nut. The axial position of the shoulder is designed so that the nut can be threaded to a final tight position on the step pin. The tight position of the nut against the shoulder squeezes the mounting flanges together to produce the desire compression pre-load. The tight position of the nut also results in the proper lateral gap between the flanges to snugly position the dipper arm in the boom arm.

To produce the desired compression pre-load, one end of the step pin is axially fixed relative to a first flange. The shank portion of the step pin extends through the second flange. An annular shim having an appropriate thickness and with a large inner diameter that fits outside the diameter of the shank portion is positioned outside the second flange. A load-transmitting washer is positioned on the reduced diameter portion of the pin adjacent to the shoulder and axially outward from the shim. As a nut is advanced on the threads of the reduced diameter portion, the washer is forced by the nut into a final contact position with the shoulder to squeeze the mounting flanges to the predetermined final lateral dimension. The shim is positioned between the washer and the mounting flange to take up the lateral space created by tolerance variations.

During assembly, however, a flat shim with a large inner diameter can shift off center and onto the shank portion of the step pin and move into the space on the reduced diameter portion of the step pin between the pin shoulder and the advancing washer. In that situation, the washer squeezes the intervening shim against the shoulder. The final position of the washer is not directly against the shoulder, which results in a larger lateral gap between the mounting flanges than the designed final lateral gap. The desired compression pre-load is not applied to the mounting flanges. As a result, subsequent twisting forces that act on the boom arm could cause a fracture at the mounting flanges.

Thus one object of the present invention is to provide a shim structure that provides for self aligning or centering of the shim outside the shank portion of the step pin during assembly so that the desired compression pre-load is applied to the mounting flanges of the boom arm.

Another object of the present invention is to provide a stackable shim that can provide the proper compression pre-load to the mounting flanges of the boom arm so as to resist undesirable twisting stress on the boom arm.

SUMMARY OF THE INVENTION

In a preferred embodiment, the present invention is an annular shim for use in combination with a pin assembly. The pin assembly includes a step pin, a washer and a threaded nut. The step pin has a shank portion with first diameter and a reduced diameter portion defined by a shoulder. The reduced diameter portion has threads for engagement with the threaded nut. The washer fits on the reduced diameter portion between the shoulder and the threaded nut. The annular shim includes an annular shim body having an inner diameter with a flat portion adjacent the inner diameter and an outer diameter with a cupped portion adjacent the outer diameter. The inner diameter fits outside the first diameter of the shank portion. The cupped portion receives the washer so as to center the inner diameter outside the shank portion and resist radial movement of the annular shim onto the shank portion as the threaded nut moves the washer into abutting contact with the shoulder.

In another embodiment, the present invention is a step pin assembly for supporting pivotal rotation of a first member relative to a second member. The first member has a pair of laterally spaced, generally parallel flanges having aligned first and second bores. The second member has a lateral bore, the flanges defining an oversized lateral gap to receive the second member when the bore of the second member is axially aligned with the aligned bores of the flanges. The step pin assembly includes a step pin having a first end, a second end and an axially extending shank portion therebetween. The first end is axially retained relative to one flange. The shank portion has a shank diameter for insertion through the axially aligned bores. The second end has a reduced diameter portion defined by a shoulder on the shank portion and has threads. The reduced diameter portion extends axially through the other flange when the shank portion is inserted into the aligned bores. A washer has an outer edge with a diameter larger than the shank diameter and an inner orifice adapted to fit on the reduced diameter portion of the step pin and move axially toward the shoulder. At least one annular shim member is positioned between the washer and the other flange. The shim member has an inner diameter and an outer diameter. The inner diameter fits outside the shank diameter. The shim has a flat portion at the inner diameter and a cupped portion at the outer diameter adapted to receive the outer edge of the washer within the cupped portion so as to restrict radial movement of the shim. A fastener is positioned adjacent the washer and has threads for engagement with the threads of the reduced diameter portion so as to threadingly move the washer into abutting contact with the shoulder of the step pin and thereby force the shim into abutting contact with the other flange.

Other objects, features, and advantages of the present invention will be readily appreciated, as the same becomes better understood after reading the subsequent description taken in conjunction with the following drawings.

DESCRIPTION OF THE PREFERRED EMBODIMENT(S)

Figure 1:
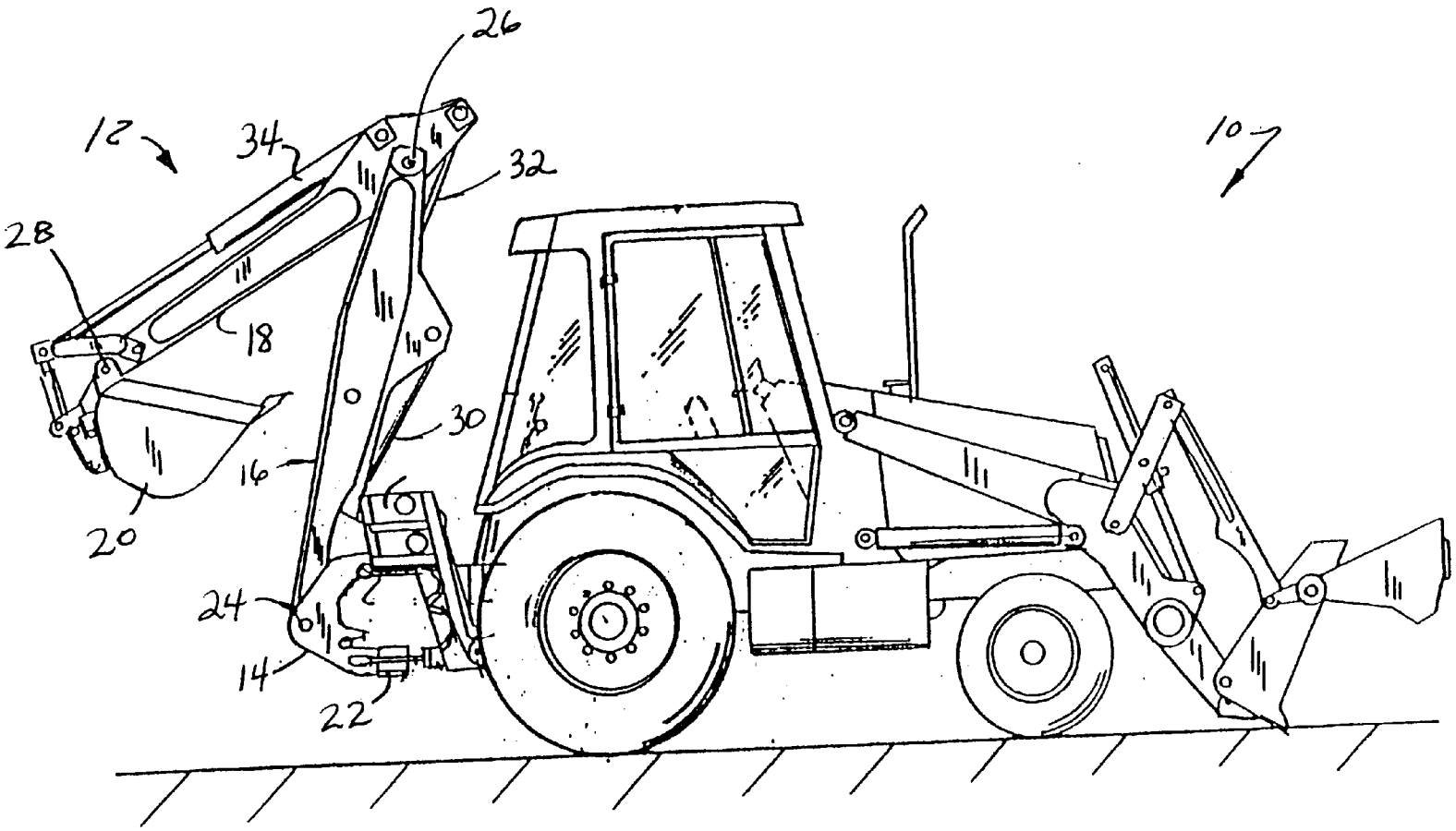
FIG. 1 shows a typical backhoe having a boom arm connected to a dipper arm with a step pin assembly according to the present invention.

Referring now to the drawings, FIG. 1 shows a typical backhoe vehicle 10 having a backhoe assembly 12 with a boom base 14, a boom arm 16, a dipper arm 18 and a bucket 20. The boom base 14 is pivotally coupled to the vehicle at its lower end and pivots about a pivot joint 22 that defines a swing axis for boom base rotation with respect to the vehicle. The boom arm 16 is pivotally coupled to the boom base 14 at its lower end by boom pivot joint 24. A pin extends between and couples the boom arm to the boom base and typically forms the boom pivot joint. The boom pivot joint allows vertical rotation of the boom arm with respect to the boom base. The dipper arm 18 is pivotally coupled to the upper or distal end of the boom arm 16 by a dipper pivot joint 26. A pin that extends between and couples the dipper arm to the boom arm typically forms the dipper pivot joint. The dipper pivot joint allows vertical rotation of the dipper arm with respect to the boom arm. The bucket 20 is pivotally couple to the far end of the dipper arm 18 by bucket pivot joint 28. The bucket pivot joint allows the bucket to pivot vertically about the dipper arm.

In addition to these basic linkages, the backhoe assembly includes several hydraulic actuators, typically dual acting, dual ported bi-directional hydraulic cylinders that cause the various linkages described above to move or pivot with respect to one another.

For example, a boom lift cylinder 30 is coupled to and between the boom arm 16 and the boom base 14 to pivot the boom arm relative to the boom base. One end of the boom lift cylinder 30 is attached to the boom arm 16 and the other end of the cylinder is attached to the boom base 14.

A dipper cylinder 32 is coupled to and between the dipper arm 18 and the boom arm 16 to pivot the dipper relative to the boom. One end of the dipper cylinder 32 is attached to the dipper arm 18 and the other end of the cylinder is attached to the boom arm 16.

A bucket cylinder 34 is coupled to and between the bucket 20 and the dipper arm 18 to pivot the bucket relative to the dipper arm. One end of the bucket cylinder 34 is attached to the bucket 20 and the other end of the cylinder is attached to the dipper arm 18.

Figure 5:
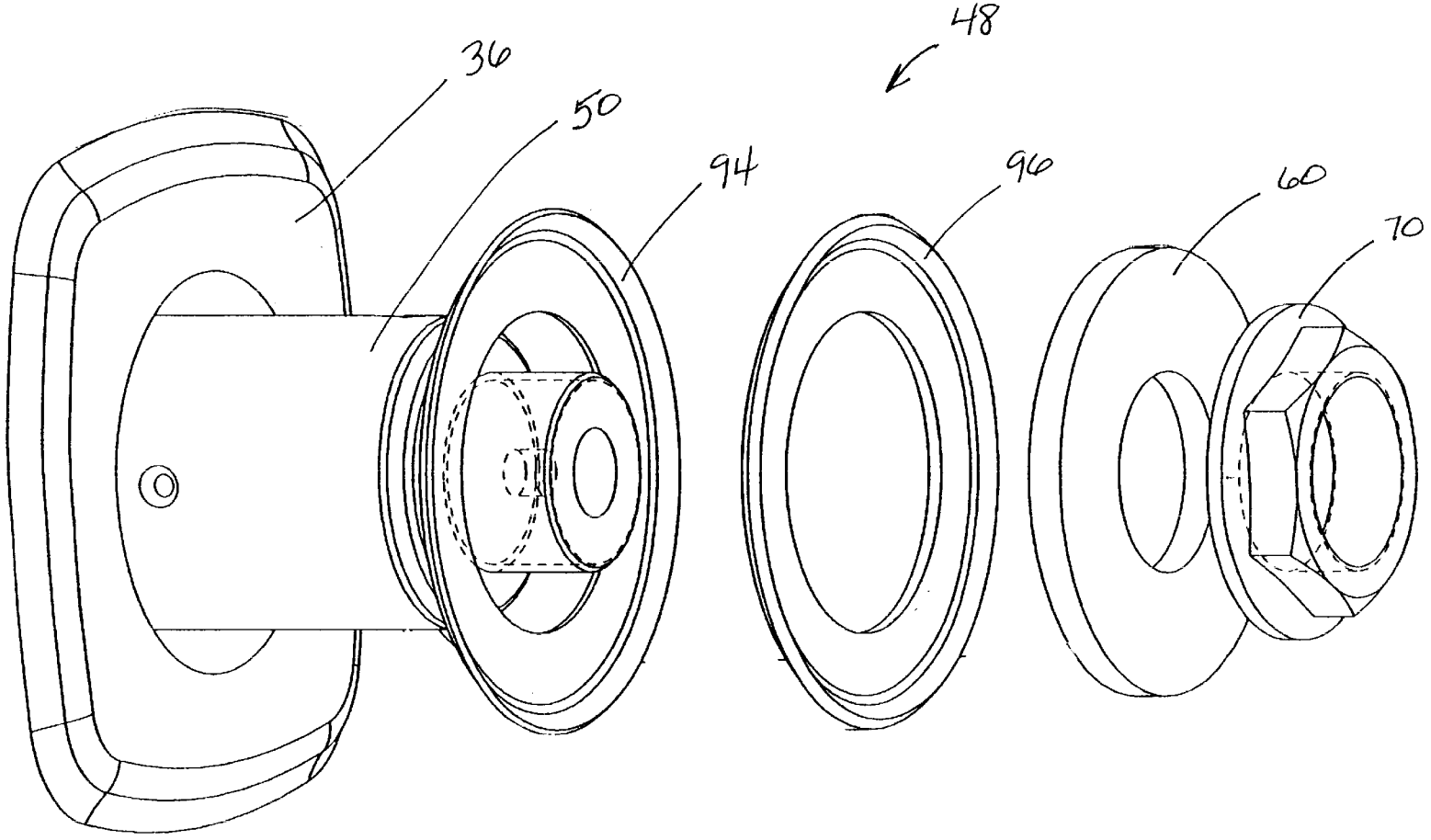
FIG. 5 is an exploded perspective view of the step pin assembly showing two stacked, continuous rim shims.

A step pin assembly 48 according to the present invention connects a first member, such as a forked boom arm 16 to a second member, such as a dipper arm 18. The step pin assembly allows the dipper arm to pivot relative to the boom arm when the dipper arm is acted on by the hydraulic boom lift cylinder 30. The step pin assembly 48, as seen in FIG. 5, includes a step pin 50, a washer 60, a threaded nut 70 and at least one annular shim 80.

Figure 2:
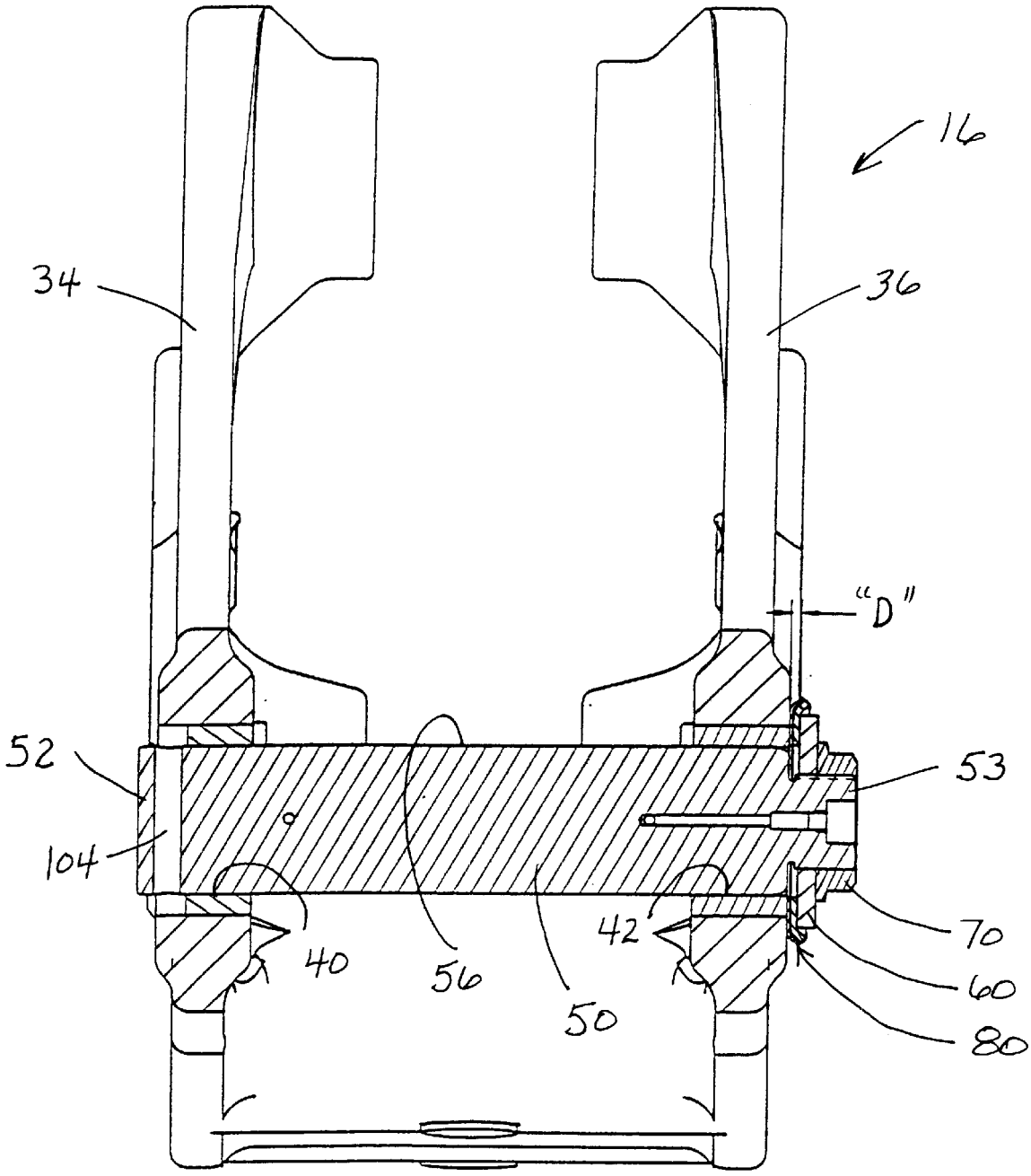
FIG. 2 shows a cross-sectional view of an uncompressed mounting flange on a boom arm using a step pin assembly of the present invention and showing the position of the washer and cupped shims before a nut is tightened onto the step pin.
Figure 3:
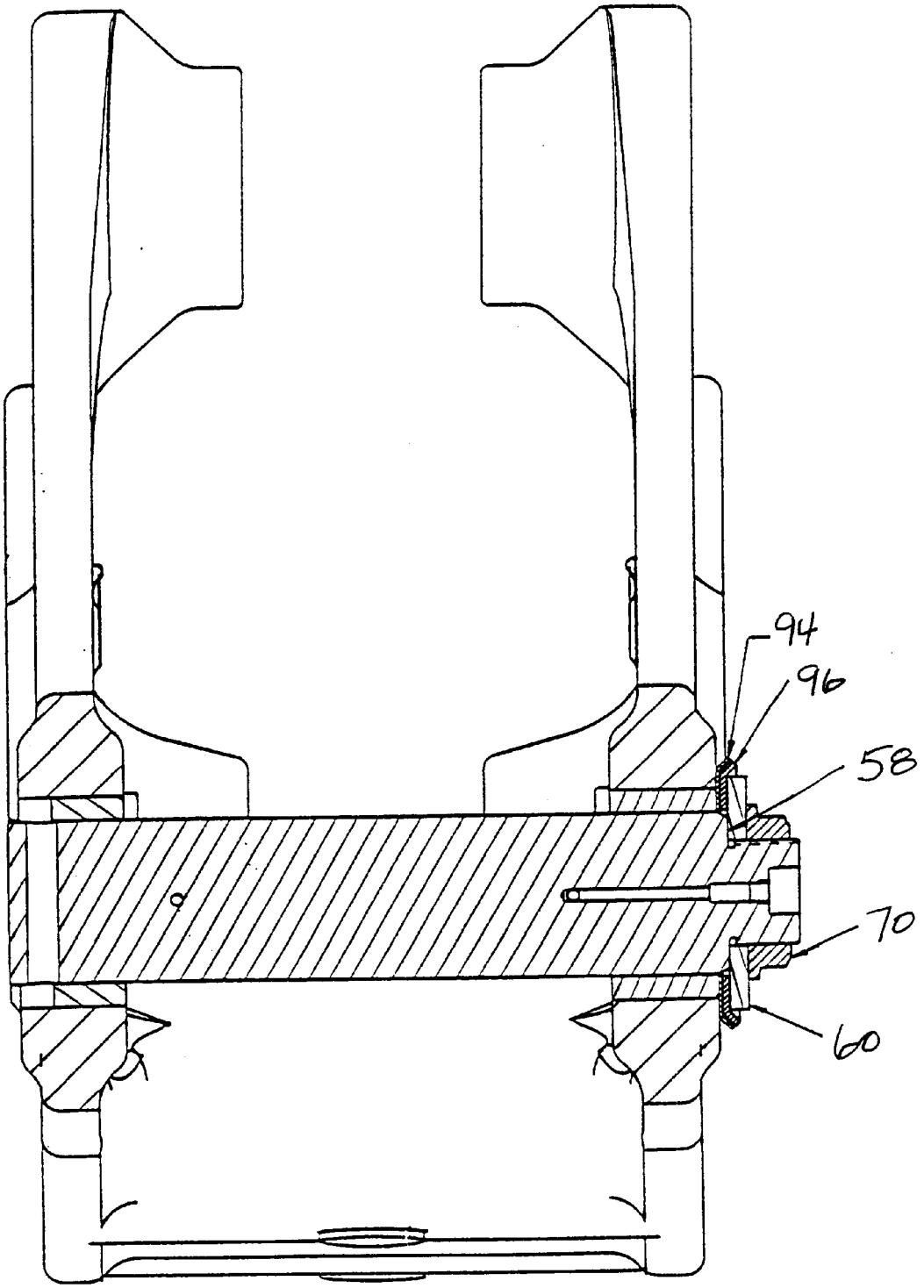
FIG. 3 is a cross-sectional view of the compressed mounting flange on a boom arm using the step pin assembly of the present invention and showing the position of the washer and cupped shims after the nut is tightened onto the step pin.
Figure 4:
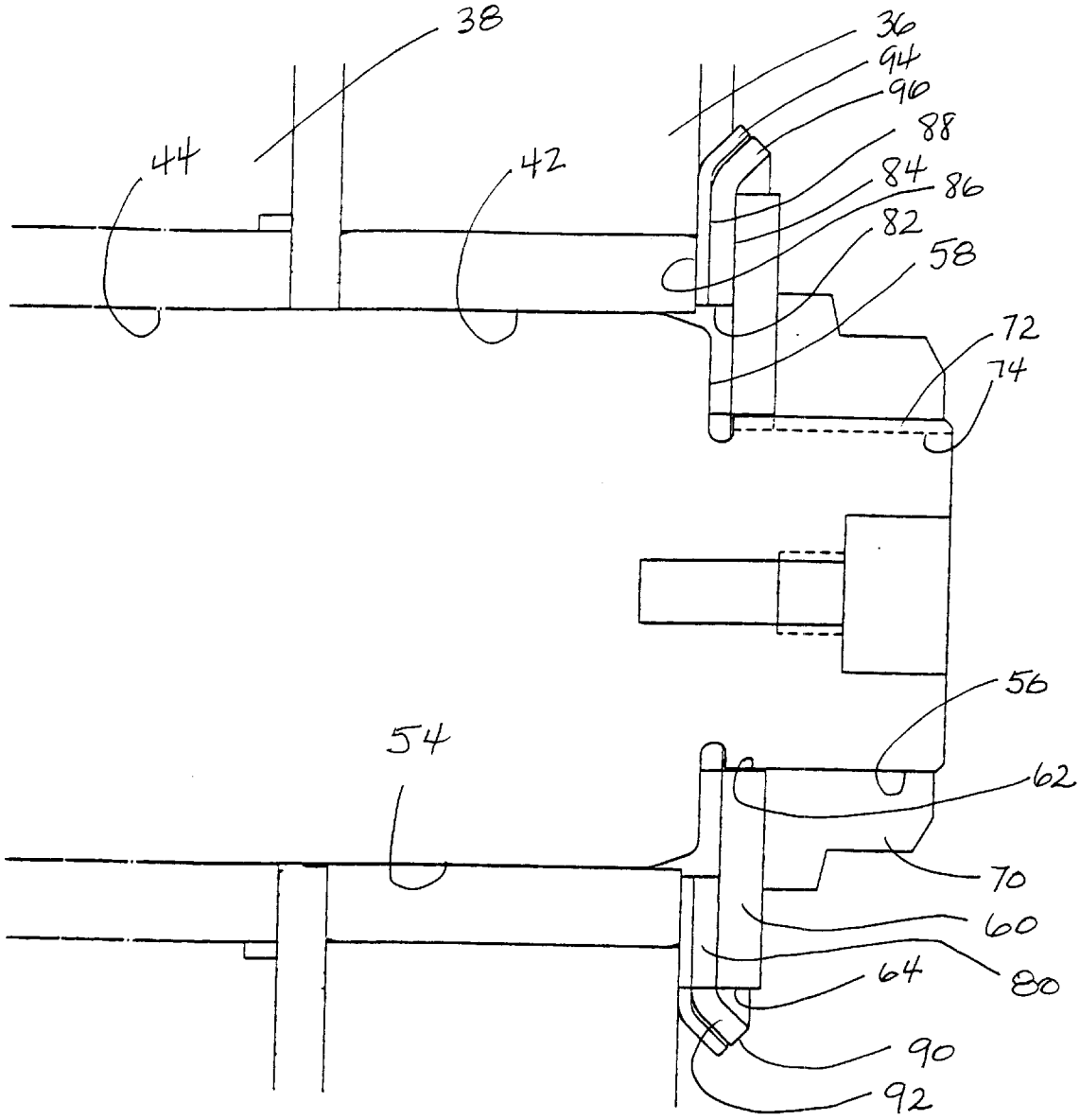
FIG. 4 is an enlarged cross-sectional view similar to the view of FIG. 2 showing the uncompressed mounting flange.

Referring now to FIGS. 2–4, the details of a boom arm and dipper arm pivot joint using the step pin assembly 48 according to the present invention is shown. As previously discussed, the boom arm 16 is economically manufactured as a single metal casting of a metal such as ductile iron and is designed to accept a compression pre-load. As shown in FIGS. 2 and 3, the boom arm 16 is cast with a pair of laterally spaced-apart and longitudinally extending mounting flanges 34 and 36. The mounting flanges are the cantilevered extensions of the distal end of the vertical plate-like members that typically form the cast boom arm. The middle length portion of the boom arms is connected by web portions that extend crosswise between the plate-like members, as previously described.

When the cast boom arm 16 is manufactured, the mounting flanges 34 and 36 are designed to define an initial oversized lateral gap. The initial oversized lateral gap has a lateral dimensioned from the inside of one flange 34 to the inside of the other flange 36 that is larger than the lateral dimension of the mounting portion 38 of the dipper arm 18. The oversized portion D of the gap is shown in FIG. 2 and is designed to allow a desired compression preload to be applied to the boom arm when the mounting flanges 34 and 36 are pulled together.

The mounting flanges 34 and 36 are manufactured with aligned first and second bores 40 and 42 that extend perpendicularly through the flanges. Alternatively, core holes having a bushing are provided, with the inner surface of the bushings define aligned bores 40 and 42.

The dipper arm 18 includes a mounting portion 38 having a lateral dimension that fits within the oversized lateral gap between the flanges 34 and 36. The mounting portion includes a bore 44, for alignment with the bores 40 and 42 of the mounting flanges. Alternatively the mounting portion may include a core hole with a bushing.

Figure 8:
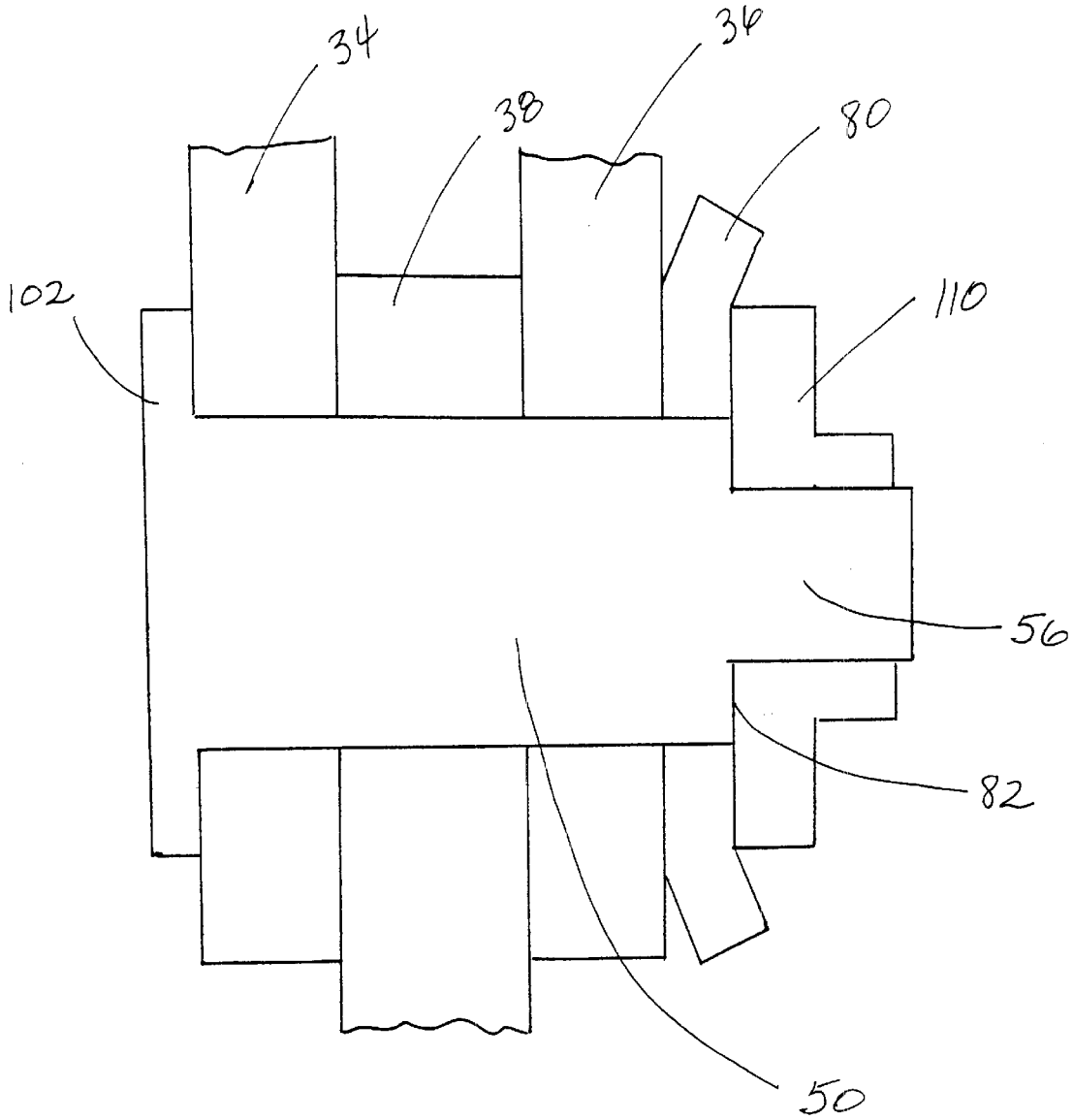
FIG. 8 shows a schematic depiction of an alternate embodiment of the step pin assembly having an integral flange nut.

The step pin 50 is provided with a first end 52, a stepped second end 53 and an axially extending cylindrical shank portion 54 therebetween. The first end 52 of the pin is axially retained relative to one of the flanges. For example, as shown in FIG. 8, the first end of the pin may have an enlarged head portion 102 that can be positioned outside the mounting flange 34. Alternatively, as shown in FIG. 2, a locking pin (not shown) can be radially inserted through a radial through-hole 104 at the first end of the step pin. The locking pin is sized to extend radially beyond the outer diameter of the first end of the shank portion 54 and into a channel on the surface of the mounting flange 34. The locking pin axially fixes one end of the step pin 50 relative to the mounting flanges. Also, when the locking pin is seated in the channel, the locking pin prevents the step pin 50 from rotating relative to the boom arm 16.

As shown in FIG. 4, the cylindrical shank portion 54 of the step pin has a shank diameter suitable for sliding insertion through the axially aligned bores 40, 42 and 44. The step pin 50 is preferably hardened so as to supporting relative pivotal rotation of the first and second members. The second end 53 of the step pin has a reduced diameter portion 56 defined by a shoulder 58 that is perpendicular to the shank portion 54. The reduced diameter portion 56 of the step pin has threads 74 on the exterior surface. When the shank portion 54 of the pin is inserted into the aligned bores, the reduced diameter portion 56 extends axially beyond the flange 36.

The step pin assembly 48 also includes at least one annular shim 80 positioned adjacent the outside of flange 36. The shim 80 has an inner diameter 82 that is slightly larger than the diameter of the shank portion 54 of the step pin so that the shim 80 will fit over and outside the shank portion 54. The shim has a flat portion 84 adjacent the inner diameter 82. The flat portion of the shim has an inner face 86 that contacts the mounting flange 36 of the boom arm. The washer 60 contacts the opposite outer face 88 of the flat portion 84 of the shim. When the annular shim 80 is properly aligned and centered around the shank portion 54, the body of the shim 80 does not contact the shoulder 58 of the step pin.

The load-transferring washer 60 is positioned on the reduced diameter portion 56 of the pin axially adjacent to the shoulder 58. The washer has an inner orifice 62 that is slightly larger than the reduced diameter portion 56 of the step pin so as to fit over and be axially movable toward the shoulder 58 on the reduced diameter portion of the pin.

The washer 60 has an outer edge 64 that is larger in diameter than the diameter of the pin shank 54 so as to overlap the flat portion 84 of the annular shim 80. The shim has an outer diameter 90 that is larger than the diameter of the outer edge 64 of the washer so as to extend beyond the washer. The shim has a cupped portion 92 adjacent to the outer diameter to receive the outer edge 64 of the washer in the cupped portion so as to restrict radial movement of the shim 80 off of the shank portion 54 of the step pin.

A nut 70 is threaded on the end of the step pin. The nut has interior threads 72 for engagement with the exterior threads 74 on the reduced diameter portion 56 of the step pin. When the nut is tightened onto the threaded portion, the nut 70 pushes the washer 60 into axial contact with the annular shim 80. Axial movement of the shim 80 causes the mounting flanges 34 and 36 to be squeezed together until the washer 60 moves into abutting contact with the shoulder 58. Thus, as the nut 70 is threaded onto the reduced diameter portion 56 of the stepped pin, the nut forces the washer 60 into abutting contact with the shoulder 58. As the nut is threaded onto the reduced diameter portion of the stepped pin, the washer 60 also forces the shim 80 axially inward compressing the mounting flange 36. The mounting flanges 34 and 36 are squeezed together between the threaded nut 70, washer 60 and shim 80 on one end of the step pin 50 and the retaining mechanism, such as the enlarged pin head or the retaining pin, at the other end of the pin. When the nut has moved the washer 60 into tight contact with shoulder 58 on the stepped pin, the compressed flanges 34 and 36 produce the desired compressive preload on the boom arm 16 to resist twisting that may be produced in the boom arm by the operation of the backhoe assembly.

Figure 6A:
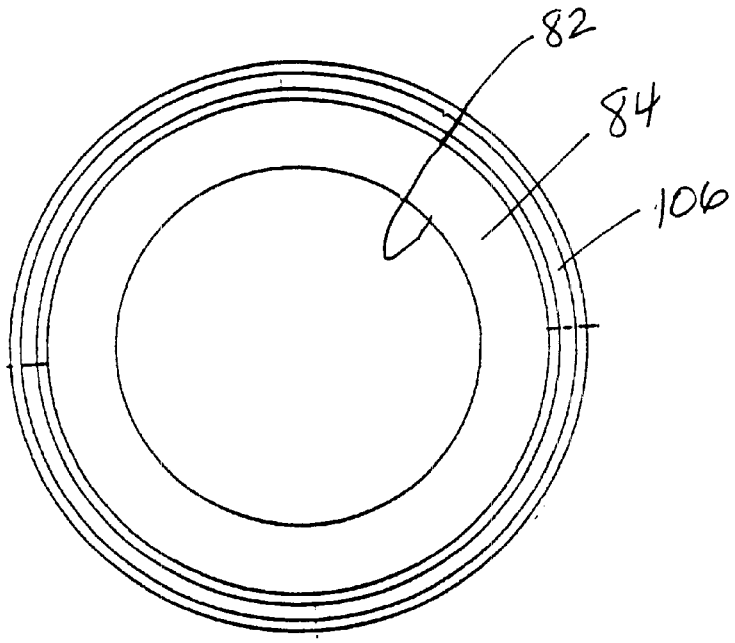
FIGS. 6A and 6B show a front and a side view respectively of an embodiment of a cupped shim with a continuous rim.
Figure 6B:
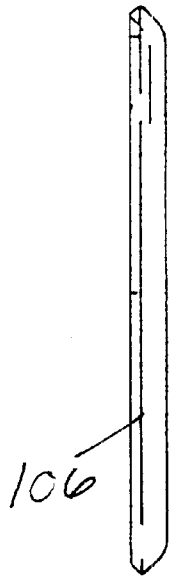
Figure 7A:
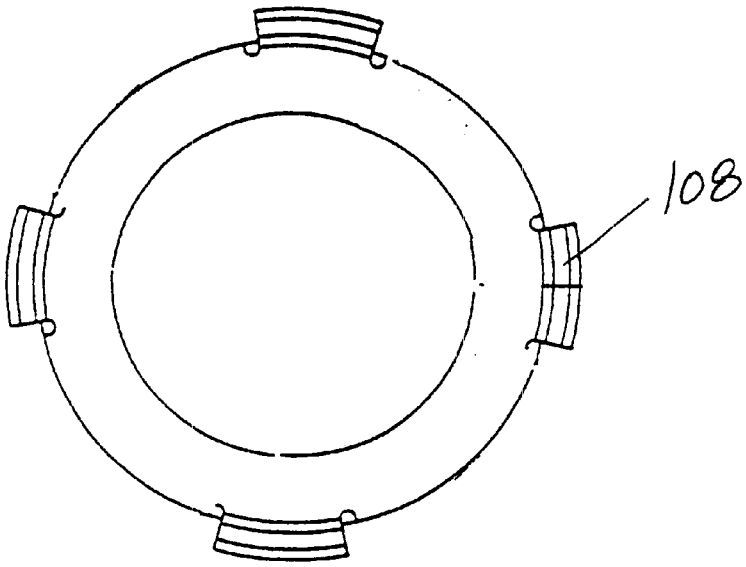
FIGS. 7A and 7B show a front and a side view of another embodiment of a cupped shim with discontinuous segments on the rim.
Figure 7B:
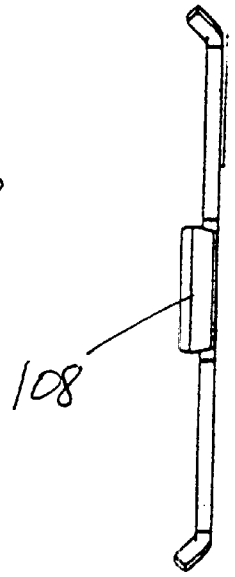

As shown in FIG. 4, the body of the shim 80 may be manufactured with a different thickness as needed. A thin shim 94 or a thick shim 96 or a stacked combination of a thin and thick shim may be positioned on the mounting flange 36 to take up the oversized gap. As shown in FIG. 6, the annular shim 80 may also have a continuous cupped rim 106. Alternatively, as shown in FIG. 7, the shim 80 may have a discontinuous rim having cupped segments 108. As shown in FIG. 4, the washer 60 is preferably a separate annular member. Alternatively, the washer may be manufactured integral with the threaded nut such as by the flange nut 110 shown in FIG. 8.

According to the invention, a cupped shim 80, or two nested shims 94 and 96, are positioned on the outside of the mounting flange and centered over and outside the reduced diameter portion of the pin. When the washer 60 is received in the cupped portion 92 of the shim, the washer centers the shims over the mounting flanges. The aligned shims can not slip out of center and overlap the shoulder 58 of the pin. Thus the cupped portion 92 of the annular shim 80 of the present invention in conjunction with the washer 60 and the tightening nut 70 prevents the shim 80 from moving radial off center on the step pin during assembly. Also the cupped portion 92 of the annular shim resist the shim from shifting off center later during operation of the equipment.

Many modifications and variations of the present invention are possible in light of the above teachings. Therefore, within the scope of the appended claims, the present invention may be practiced otherwise than as specifically described.

What is claimed is:

1. An annular shim for use in combination with a pin assembly, the pin assembly including a step pin, a washer and a threaded nut, the step pin having a shank portion with first diameter and a reduced diameter portion defined by a shoulder, the reduced diameter portion having threads for engagement with the threaded nut, the washer fitting on the reduced diameter portion between the shoulder and the threaded nut, the annular shim comprising:

an annular shim body having an inner diameter with a flat portion adjacent the inner diameter and an outer diameter with a cupped portion adjacent the outer diameter, the inner diameter fitting outside the first diameter of the shank portion, the cupped portion receiving the washer so as to center the inner diameter outside the shank portion and resist radial movement of the annular shim onto the shank portion as the threaded nut moves the washer into abutting contact with the shoulder.

2. The combination of claim 1 wherein the washer and threaded nut comprise an integral flange nut.

3. The combination of claim 1 wherein the washer is an annular member having an outer edge larger than the first diameter of the shank portion and an inner orifice fitting on the reduced diameter portion of the step pin so that the washer is centered in the cupped portion of the annular shim and resists radial movement of the annular shim off the washer.

4. The combination of claim 1, wherein cupped portion comprises a continuous raised rim around the outer diameter of the annular shim.

5. The combination of claim 1, wherein the cupped portion comprises discontinuous cupped segments around the outer diameter of the annular shim.

6. The combination of claim 1 wherein the annular shim further comprises a first and a second annular shim, wherein the second shim is nested in the first shim.

7. The combination of claim 1, wherein the pin assembly pivotally secures a pivoting member between a pair of laterally compressed flanges of a supporting member.

8. A step pin assembly for supporting pivotal rotation of a first member relative to a second member, the first member having a pair of laterally spaced, generally parallel flanges having aligned first and second bores, the second member having a lateral bore, the flanges defining an oversized lateral gap to receive the second member when the bore of the second member is axially aligned with the aligned bores of the flanges, the step pin assembly comprising:

a step pin having a first end, a second end and an axially extending shank portion therebetween, the first end being axially retained relative to one flange, the shank portion having a shank diameter for insertion through the axially aligned bores, the second end being a reduced diameter portion defined by a shoulder on the shank portion and having threads, the reduced diameter portion extending axially through the other flange when the shank portion is inserted into the aligned bores;

a washer having an outer edge with a diameter larger than the shank diameter and an inner orifice adapted to fit on the reduced diameter portion of the step pin and move axially toward the shoulder;

at least one annular shim member positioned between the washer and the other flange, the shim member having an inner diameter and an outer diameter, the inner diameter fitting outside the shank diameter, the shim having a flat portion at the inner diameter and a cupped portion at the outer diameter adapted to receive the outer edge of the washer within the cupped portion so as to restrict radial movement of the shim; and a fastener positioned adjacent the washer and having threads for engagement with the threads of the reduced diameter portion so as to threadingly move the washer into abutting contact with the shoulder of the step pin and thereby force the shim into abutting contact with the other flange.

9. The step pin assembly of claim 8, wherein the cupped portion comprises a continuous rim around the outer diameter of the shim.

10. The step pin assembly of claim 8, wherein the cupped portion comprises discontinuous segments around the outer diameter of the shim.

11. The step pin assembly of claim 8, wherein the at least one shim is a first shim having a first thickness nested in a second shim having a second thickness.

12. A step pin assembly for applying a compression preload to a first forked member pivotally coupled to a second member, the first member having a pair of laterally spaced, generally parallel flanges having aligned first and second bores, the second member having a lateral bore, the flanges defining an oversized lateral gap to receive the second member with clearance when the bore of the second member is axially aligned with the aligned bores of the flanges, the step pin assembly comprising:

a step pin having a first end, a second end and an axially extending shank portion therebetween, the first end being axially retained relative to one of the pair of flanges, the shank portion having a shank diameter for sliding insertion through the axially aligned bores and for supporting pivotal rotation of the first and second members relative to each other, the second end being a reduced diameter portion defined by a shoulder on the step pin and having threads, the reduced diameter portion extending axially beyond the other flange when the shank portion is inserted into the aligned bores;

a washer having an outer edge with a diameter greater than the shank diameter and an inner diameter less than the shank diameter and greater than the reduced diameter portion of the step pin, the washer positioned on the reduced diameter portion axially adjacent to the shoulder;

at least one shim having an inner diameter greater than the shank diameter and an outer diameter greater than the outer diameter of the outer edge of the washer, the shim having a flat portion at the inner diameter and a cupped portion at the outer diameter and positioned between the other flange and the washer to receive the outer diameter of the washer in the cupped portion so as to restrict radial movement of the shim; and a fastener positioned adjacent to the washer and having threads for engagement with the threads of the reduced diameter portion so as to axially force the washer into abutting contact with the shoulder on the step pin and to move the shim into abutting contact with the other flange, thereby taking up the oversized portion of the lateral gap and applying a compression preload to the forked member.

* * * * *